US011495427B2

(12) United States Patent
Zheng et al.

(10) Patent No.: US 11,495,427 B2
(45) Date of Patent: Nov. 8, 2022

(54) LEAKAGE PROTECTOR

(71) Applicant: KEDU ELECTRIC CO., LTD., Zhejiang (CN)

(72) Inventors: Chunkai Zheng, Zhejiang (CN); Ziping Li, Zhejiang (CN); Jun Liao, Zhejiang (CN); Desheng Zhao, Zhejiang (CN)

(73) Assignee: KEDU ELECTRIC CO., LTD., Wenzhou (CN)

( * ) Notice: Subject to any disclaimer, the term of this patent is extended or adjusted under 35 U.S.C. 154(b) by 41 days.

(21) Appl. No.: 17/341,652

(22) Filed: Jun. 8, 2021

(65) Prior Publication Data

US 2021/0296071 A1 Sep. 23, 2021

(30) Foreign Application Priority Data

Dec. 2, 2020 (CN) ..... 202011406342.5

(51) Int. Cl.

| | |
|---|---|
| ***H01H 71/74*** | (2006.01) |
| ***H01H 71/08*** | (2006.01) |
| ***H01R 13/70*** | (2006.01) |
| ***H01R 13/713*** | (2006.01) |

(52) U.S. Cl.
CPC ..... *H01H 71/74* (2013.01); *H01H 71/08* (2013.01); *H01R 13/701* (2013.01); *H01R 13/713* (2013.01)

(58) Field of Classification Search
CPC ..... H02H 3/335; H02H 3/16; H02H 3/044; H02H 3/33; H02H 3/20; H02H 3/00; H02H 3/14; H02H 5/083; H02H 5/12; H02H 7/226; H02H 1/0015; H02H 1/0061; H02H 1/0092; H02H 1/0038; H02H 1/0069
See application file for complete search history.

(56) References Cited

U.S. PATENT DOCUMENTS

2008/0094764 A1* 4/2008 Zhang ..... H01R 13/6691 29/729

FOREIGN PATENT DOCUMENTS

| | | |
|---|---|---|
| CN | 202333729 U | 7/2012 |
| CN | 203326560 U | 12/2013 |
| CN | 207409777 U | 5/2018 |
| CN | 210223925 U | 3/2020 |
| CN | 212434520 U | 1/2021 |

* cited by examiner

*Primary Examiner* — Bryan R Perez
(74) *Attorney, Agent, or Firm* — Wayne IP LLC

(57) ABSTRACT

Disclosed herein is a leakage protector, which includes a housing. A base plate and a brush are arranged in the housing. A first conducting strip and a second conducting strip spaced apart are arranged on the base plate. The brush is provided with contact pins to contact the first conducting strip and the second conducting strip, respectively. The second conducting strip can generate different analog voltages, and the first conducting strip is configured to transmit different analog voltages to a microprocessor. A user can drive the brush to move through an actuating part, and set the power-on time of the leakage protector in one step.

12 Claims, 9 Drawing Sheets

LEAKAGE PROTECTOR

CROSS-REFERENCE TO RELATED APPLICATIONS

This application claims the benefit of priority from Chinese Patent Application No. 202011406342.5, filed on Dec. 2, 2020. The content of the aforementioned application, including any intervening amendments thereto, is incorporated herein by reference in its entirety.

TECHNICAL FIELD

This application relates to emergency protection devices for circuit, and more particularly to a leakage protector.

BACKGROUND

In the production and daily life, the use of some power equipment is time-limited, and the electrical equipment must be turned off in time after use.

The leakage protector can realize the timing shutdown of the power equipment. In the existing leakage protectors, the power-on time is usually set through repeatedly pressing a button, and a digital tube is provided to determine whether the set power-on time is the desired power-on time. The leakage protector will be powered off after the set power-on time is reached, so as to turn off the power equipment. Given the above, the existing leakage protectors struggle with inconvenient operation, complicated structure and high cost.

SUMMARY

To solve the problem in the prior art that the power-on time of the leakage protectors is set through repeatedly pressing a button, the present discourse provides a leakage protector with convenient and efficient set of the power-on time.

Technical solutions of the disclosure are described as follows.

The present disclosure provides a leakage protector, which is used to connect in series with external power equipment to control the timing shutdown thereof. The leakage protector comprises:

a housing;

wherein a base plate, a brush and a microprocessor are arranged in the housing; the brush is arranged on the base plate; the brush is movable with respect to the base plate; an actuating part is arranged on the housing; the brush is connected to the actuating part; the base plate is provided with a first conducting strip and a second conducting strip; the first conducting strip and the second conducting strip are spaced apart; the first conducting strip is electrically connected to the microprocessor;

the brush is provided with a first contact pin and a second contact pin; the first contact pin is in contact with the first conducting strip; the second contact pin is in contact with the second conducting strip; the actuating part is configured to drive the brush to move, such that the first contact pin is in contact with different positions of the first conducting strip, and the second contact pin is in contact with different positions of the second conducting strip, so as to allow the second conducting strip to generate different analog voltages;

the first conducting strip is configured to receive an analog-voltage signal generated by the second conducting strip, and transmit the analog-voltage signal to the microprocessor; and the microprocessor is configured to control the leakage protector to turn off after reaching a power-on time corresponding to the analog-voltage signal according to the received analog-voltage signal, such that the external power equipment is turned off.

In some embodiments, the second conducting strip comprises a plurality of conductive areas respectively corresponding to the different analog voltages; and the second contact pin is configured to contact the plurality of conductive areas, so as to allow the second conducting strip to generate the different analog voltages corresponding to the plurality of conductive areas.

In some embodiments, the second conducting strip is provided with a notch; and when the second contact pin is accommodated in the notch, the second conducting strip does not generate an analog voltage.

In some embodiments, a hand-sensing mechanism is arranged in the housing; the actuating part is connected to the hand-sensing mechanism; a plurality of positioning grooves are provided on an inner wall of the housing; the hand-sensing mechanism is engageable with the plurality of positioning grooves; and the actuating part is configured to drive the hand-sensing mechanism to rotate with respect to the housing, such that the hand-sensing mechanism is able to engage with the plurality of positioning grooves in sequence.

In some embodiments, the hand-sensing mechanism comprises a fixing seat, an elastic part and a sliding part; the fixing seat is connected to the actuating part; one end of the elastic part is connected to the fixing seat; the other end of the elastic part is connected to the sliding part; the sliding part is engageable with the plurality of positioning grooves; the actuating part is configured to drive the fixing seat to rotate, so as to drive the sliding part to move through the elastic part to allow the sliding part to be engaged with the plurality of positioning grooves in sequence; and the elastic part is configured to provide the sliding part with an elastic force to keep the sliding part in engagement with one of the plurality of positioning grooves.

In some embodiments, a counterbore is arranged on a side wall of the fixing seat; the elastic part is arranged in the counterbore; and the sliding part is partially accommodated in the counterbore.

In some embodiments, the fixing seat is provided with a clamping slot; an inner wall of the clamping slot is provided with a clamping parting surface; an end of the actuating part facing the brush is provided with a clamping column; a clamping part is arranged at a lower end of the clamping column; the clamping column is inserted into the clamping slot; and the clamping part is clamped with the clamping parting surface, so as to enable the fixing seat to be clamped with the actuating part.

In some embodiments, the brush is rotatably connected to the base plate; and the actuating part is configured to drive the brush to rotate, such that the first contact pin is in contact with different positions of the first conducting strip, and the second contact pin is in contact with different positions of the second conducting strip.

In some embodiments, the first conducting strip and the second conducting strip are concentrically arranged, and both have a ring structure.

In some embodiments, the base plate is provided with a positioning hole; the actuating part is provided with a positioning shaft; the positioning shaft is inserted into the positioning hole, such that the actuating part is rotatably connected to the base plate; the positioning shaft is provided with a limiting protrusion; the brush is provided with a connecting hole configured for matching with the limiting protrusion; and the limiting protrusion is inserted into the connecting hole, so as to enable the actuating part to be clamped with the brush.

In some embodiments, a sealing ring is provided between the actuating part and the housing; and the sealing ring is configured to enable sealing between the actuating part and the housing.

In some embodiments, a lower end of the actuating part is provided with an inner annular wall; the housing is provided with an annular protrusion opposite to the inner annular wall; an upper end of the sealing ring is provided with a first annular groove; the first annular groove is configured for insertion of the inner annular wall to enable sealing between the sealing ring and the actuating part; a lower end of the sealing ring is provided with a second annular groove; and the second annular groove is configured for insertion of the annular protrusion to enable sealing between the sealing ring and the housing.

The beneficial effects of the present disclosure are described as follows.

In the leakage protector provided herein, a base plate is arranged in a housing, and a first conducting strip, a second conducting strip and a microprocessor are arranged on the base plate. A second contact pin of a brush is in contact with the second conducting strip. A first contact pin of the brush is in contact with the first conducting strip. When the second contact pin contacts different position of the second conducting strip, the second conducting strip can generate different analog voltages and transmit the different analog voltages to the microprocessor through the first conducting strip. The microprocessor controls a power-on time of the leakage protector according to the different analog voltages received. The brush can be driven to move through the actuating part, and the power-on time of the leakage protector can be set in one step, so as to control the timing shutdown of the external power equipment. The operation is convenient and efficient, and the cost is relatively low since the actuating part adopts a mechanical structure.

BRIEF DESCRIPTION OF THE DRAWINGS

The disclosure will be described in detail below with reference to the accompanying drawings and embodiments to make the technical solutions of this disclosure clearer. Obviously, presented in the accompanying drawings are merely some embodiments of the disclosure, and other drawings can be made by those skilled in the art based on the drawings provided herein without sparing creative effort.

Figure 1:
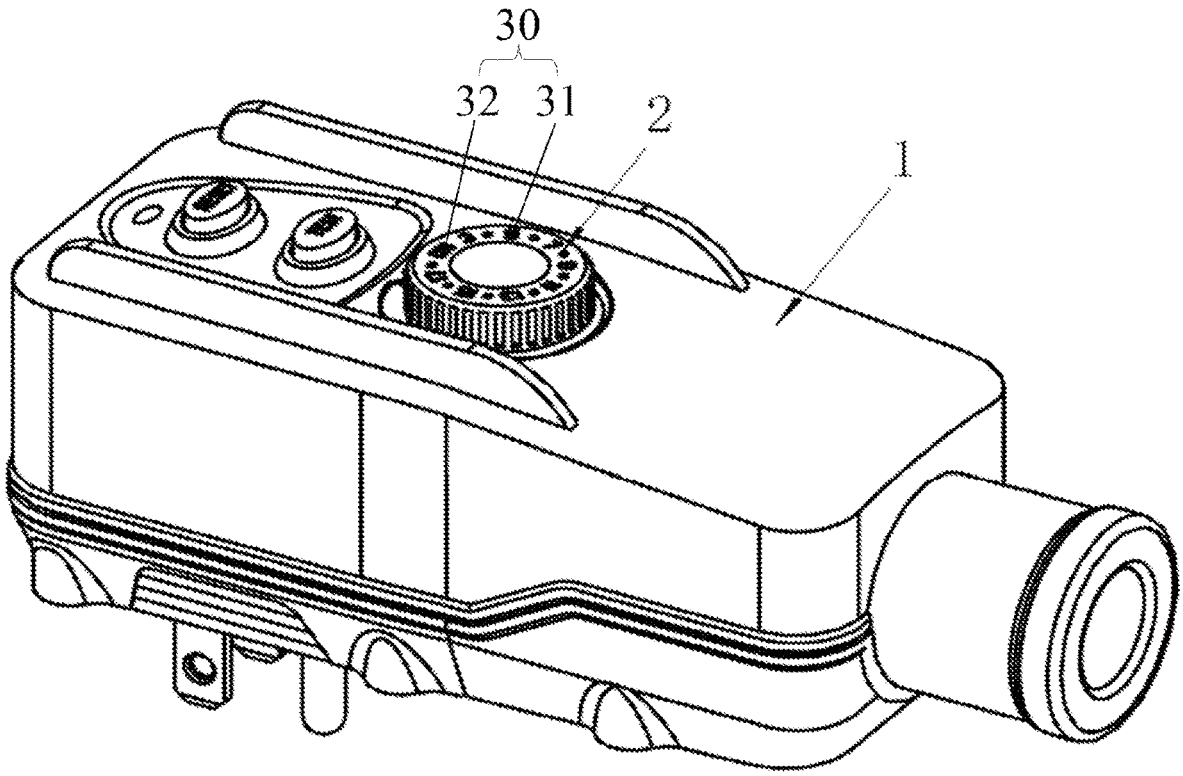
FIG. 1 is a perspective view of a leakage protector in accordance with an embodiment of the present disclosure.

In the drawing, 1, housing; 2, actuating part; 3, base plate; 4, brush; 5, positioning hole; 6, first conducting strip; 7, second conducting strip; 8, through hole; 9, first contact pin; 10, second contact pin; 11, connecting hole; 12, positioning shaft; 13, limiting protrusion; 14, clamping column; 15, clamping part; 16, inner annular wall; 17, fixing seat; 18, counterbore; 19, clamping slot; 20, clamping surface; 21, positioning groove; 22, sealing ring; 23, first annular groove; 24, second annular groove; 25, elastic part; 26, sliding part; 27, notch; 28, hand-sensing mechanism; 29, annular protrusion; 30, mark; 31, numerical value; 32, letter; 33, microprocessor; 34, conductive area; and 35, positioning part.

DETAILED DESCRIPTION OF EMBODIMENTS

The technical solutions of this disclosure will be clearly and completely described below with reference to the accompanying drawings and embodiments. Obviously, the embodiments described herein are illustrative of the disclosure, and are not intended to limit the present disclosure. Other embodiments made by those skilled in the art based on the content disclosed herein without sparing any creative effort should fall within the scope the present disclosure.

As used herein, the orientation or position terms, such as "center", "upper", "lower", "left", "right", "vertical", "horizontal", "inner" and "outer", are intended to illustrate the orientation or positional relationship shown in the drawings. These terms are merely illustrative of this disclosure, and do not indicate or imply that the device or element referred to must have the specified orientation, or must be constructed and operated in the specified orientation. Therefore, these terms should not be interpreted as a limitation to this disclosure. In addition, the terms "first", "second" and "third" are only used for description, and should not be understood to indicate or imply the relative importance.

As used herein, it should be noted that unless otherwise specified, the terms "install", "connect" and "link" should be understood in a broad sense. For example, it can be interpreted as fixed connection, replaceable connection or integral connection, or can be interpreted as mechanical connection or electrical connection, or can be interpreted as direct connection or indirect connection through an intermediate medium, or can be interpreted as communication between two elements. For those skilled in the art, the specific meanings of the above terms can be understood according to the corresponding description.

In addition, the technical features involved in the different embodiments of this disclosure described below can be combined with each other as long as they do not conflict with each other.

Figure 2:
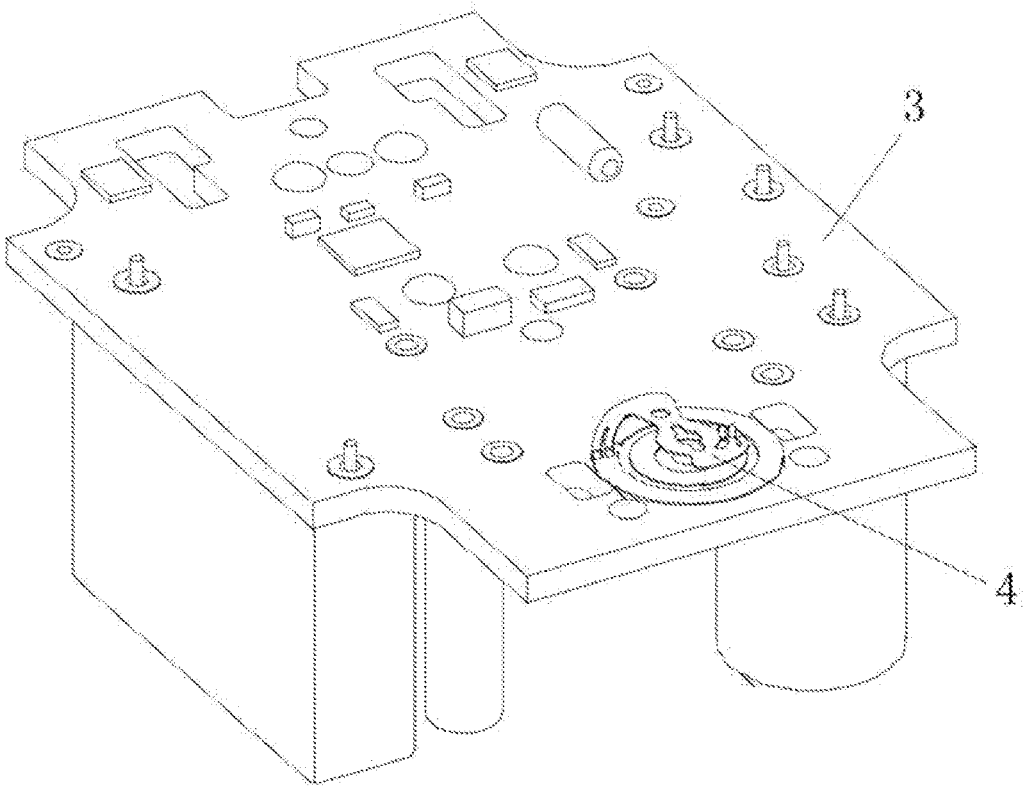
FIG. 2 schematically depicts matching between a brush and a base plate in a housing of the leakage protector in accordance with an embodiment of the present disclosure.
Figure 3:
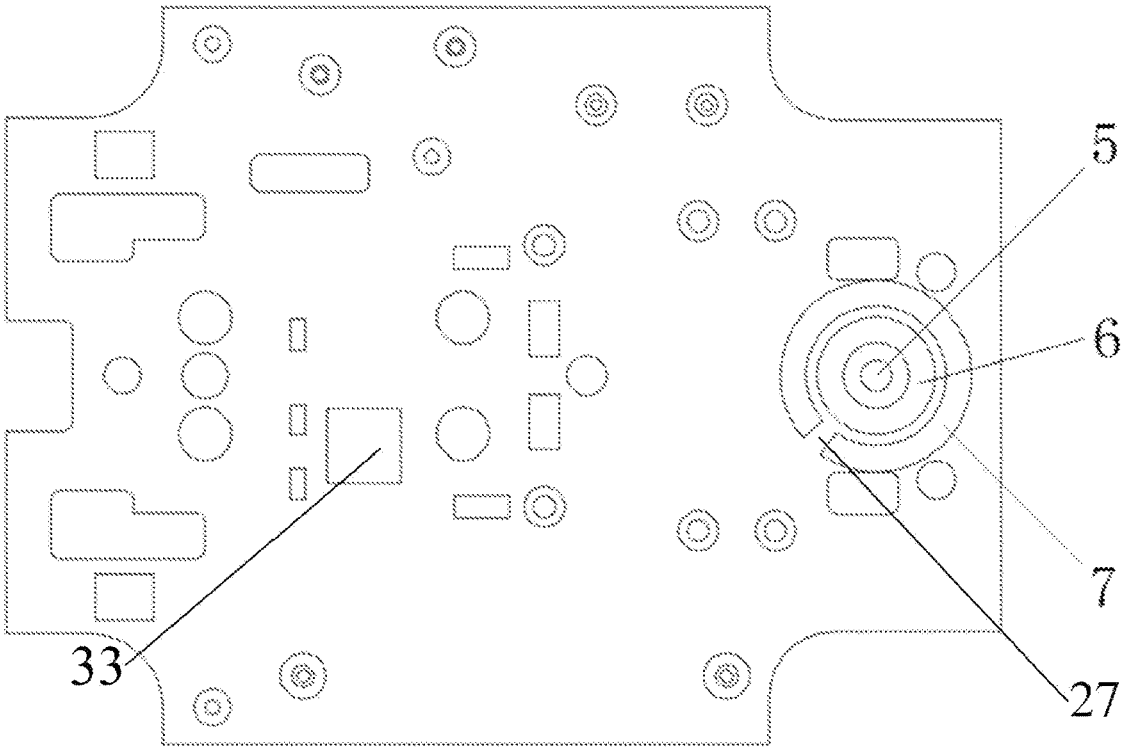
FIG. 3 is a top view of the base plate in accordance with an embodiment of the present disclosure.

As shown in FIGS. 1-5, a leakage protector is used to connect in series with external power equipment to control a timing shutdown of the external power equipment. The leakage protector includes a housing 1. A base plate 3, a brush 4 and a microprocessor 33 are arranged in the housing 1. The brush 4 is arranged on the base plate 3, and the brush 4 is movable with respect to the base plate 3. An actuating part 2 is arranged on the housing 1. As shown in FIG. 3, the base plate 3 is provided with a first conducting strip 6 and a second conducting strip 7 spaced apart. The first conducting strip 6 is electrically connected to the microprocessor 33. The brush 4 is provided with a first contact pin 9 and a second contact pin 10. The first contact pin 9 is in contact with the first conducting strip 6, and the second contact pin 10 is in contact with the second conducting strip 7. The actuating part 2 is configured to drive the brush 4 to move, such that the first contact pin 9 is in contact with different positions of the first conducting strip 6, and the second contact pin 10 is in contact with different positions of the second conducting strip 7, so as to allow the second conducting strip 7 to generate different analog voltages. The first conducting strip 6 is configured to receive an analog-voltage signal generated by the second conducting strip 7, and transmit the analog-voltage signal to the microprocessor 33. The microprocessor 33 is configured to control the leakage protector to turn off after reaching a power-on time corresponding to the analog-voltage signal according to the received analog-voltage signal, such that the external power equipment is turned off. Specifically, each analog voltage is corresponded to a power-on time, and according to the received analog-voltage signal, the microprocessor 33 controls the leakage protector to turn off after the leakage protector operates for the corresponding power-on time.

A user can drive the brush 4 to move through the actuating part 2, such that the power-on time of the leakage protector can be set in one step, and the timing shutdown of the external electric equipment is controlled. This operation is convenient and efficient. In addition, the actuating part 2 adopts a mechanical structure, reducing the cost thereof.

In an embodiment, the base plate 3 is a circuit board.

In an embodiment, the base plate 3 is provided with a circuit configured for electrically connecting the first conducting strip 6 and the microprocessor 33.

In an embodiment, the brush 4 is rotatably connected to the base plate 3. The actuating part 2 is configured to drive the brush 4 to rotate, such that the first contact pin 9 is in contact with different positions of the first conducting strip 6, and the second contact pin 10 is in contact with different positions of the second conducting strip 7.

As shown in FIG. 3, the first conducting strip 6 and the second conducting strip 7 are concentrically arranged, and both have in a ring structure. In an embodiment, when the brush 4 rotates, the trajectories of the first contact pin 9 and the second contact pin 10 are both circular. The concentric arrangement of first conducting strip 6 and the second conducting strip 7 can prevent the first contact pin 9 from separating from the first conducting strip 6 and prevent the second contact pin 10 from separating the second conducting strip 7 when the brush 4 rotates.

The actuating part 2 provided in this embodiment is a knob, and the knob is rotatable, so as to drive the brush 4 to rotate, such that the first contact pin 9 is in contact with the different positions of the first conducting strip 6, and the second contact pin 10 is in contact with the different positions of the second conducting strip 7. The knob can be driven either stepwise or steplessly. In another embodiment, the actuating part 2 is a sliding button. The sliding button is slidably arranged on the housing 1. The sliding button is slid to drive the brush 4 to slide, such that the first contact pin 9 is in contact with the different positions of the first conducting strip 6, and the second contact pin 10 is in contact with the different positions of the second conducting strip 7. In another embodiment, the actuating part 2 is a pressing button. The press button is arranged on the housing 1, and can be pressed. By pressing the pressing button, the brush 4 in the housing 1 can be driven to rotate. The specific structure can refer to a button structure of an automatic ballpoint pen.

As shown in FIG. 1, a mark 30 is arranged on the actuating part 2. The mark 30 includes a numerical value 31 and a letter 32 (letter ON). The housing 1 is provided with an indicating arrow 1, and the indicating arrow is arranged close to the actuating part 2. When the letter 32 (letter ON) on the actuating part 2 is facing the indicating arrow, the leakage protector remains on. When the numerical value 31 on the actuating part 2 is facing the indicating arrow, a time indicated by the numerical value 31 is the power-on time of the leakage protector, and the leakage protector will be powered off after the power-on time is reached.

Figure 4:
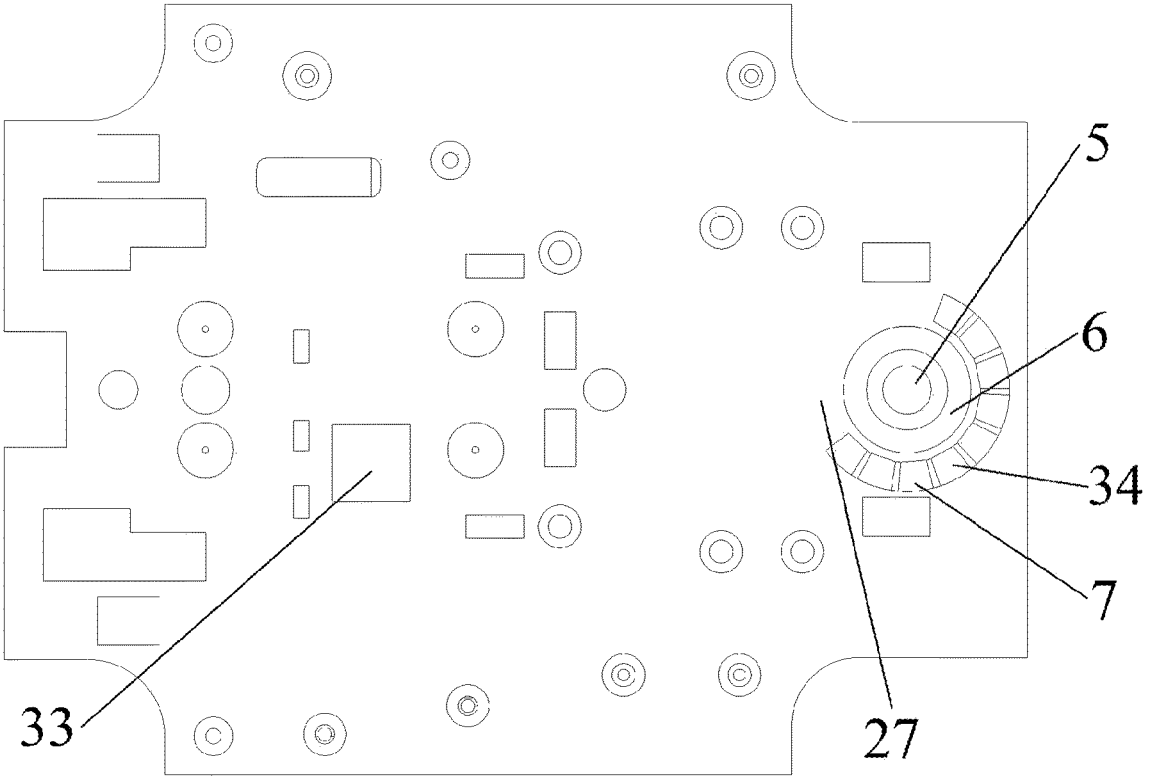
FIG. 4 is a top view of the base plate in accordance with another embodiment of the present disclosure.

As shown in FIG. 4, the second conducting strip 7 includes a plurality of conductive areas 34 respectively corresponding to different analog voltages, and the second contact pin 10 is configured to contact different conductive areas 34, so as to allow the second conducting strip 7 to generate the analog voltages corresponding to conductive areas 34.

As shown in FIG. 3, the second conducting strip 7 is provided with a notch 27. When the second contact pin 10 is accommodated in the notch 27, the second conducting strip 7 does not generate the analog voltage. Specifically, when the second contact pin 10 of the brush 4 is accommodated in the notch 27 of the second conducting strip 7, the first conducting strip 6 has no analog-voltage signal to transmit to the microprocessor 33. At this time, the leakage protector can remain on.

As shown in FIGS. 2-3, the base plate 3 is provided with a positioning hole 5, and the brush 4 is rotatably connected in the positioning hole 5.

As shown in FIGS. 5-8, the actuating part 2 is provided with a positioning shaft 12. The positioning shaft 12 is inserted into the positioning hole 5, such that the actuating part 2 is rotatably connected to the base plate 3. The positioning shaft 12 is provided with a limiting protrusion 13. The brush 4 is provided with a connecting hole 11 configured for matching with the limiting protrusion 13, and the limiting protrusion 13 is inserted into the connecting hole 11, so as to enable the actuating part 2 to be clamped with the brush 4.

Figure 5:
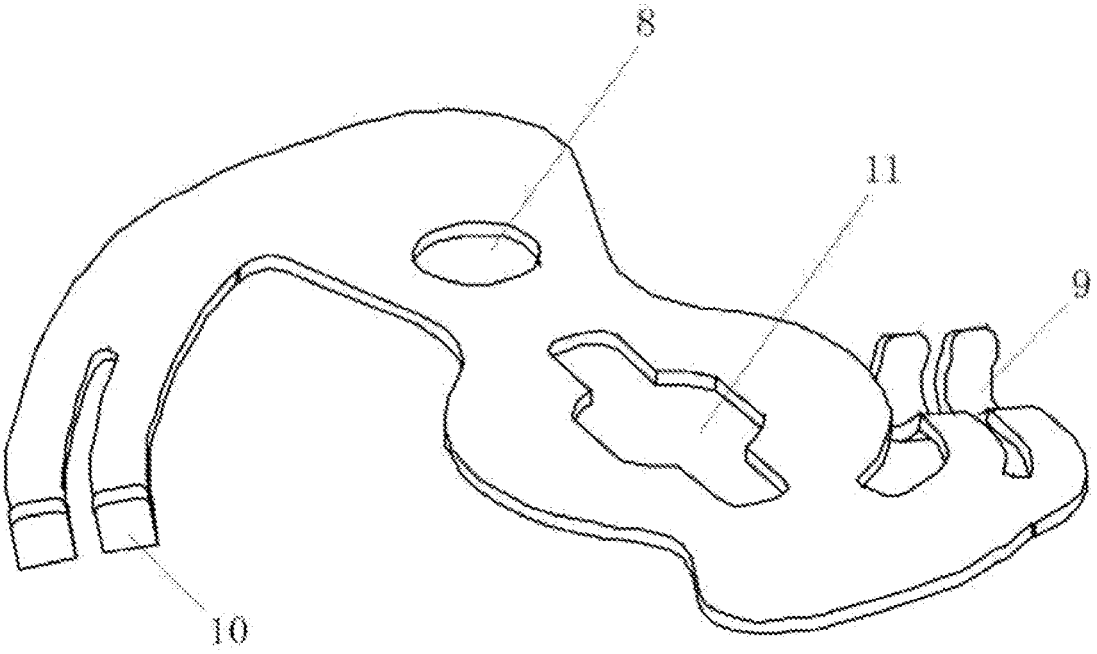
FIG. 5 is a perspective view of the brush in accordance with an embodiment of the present disclosure.
Figure 6:
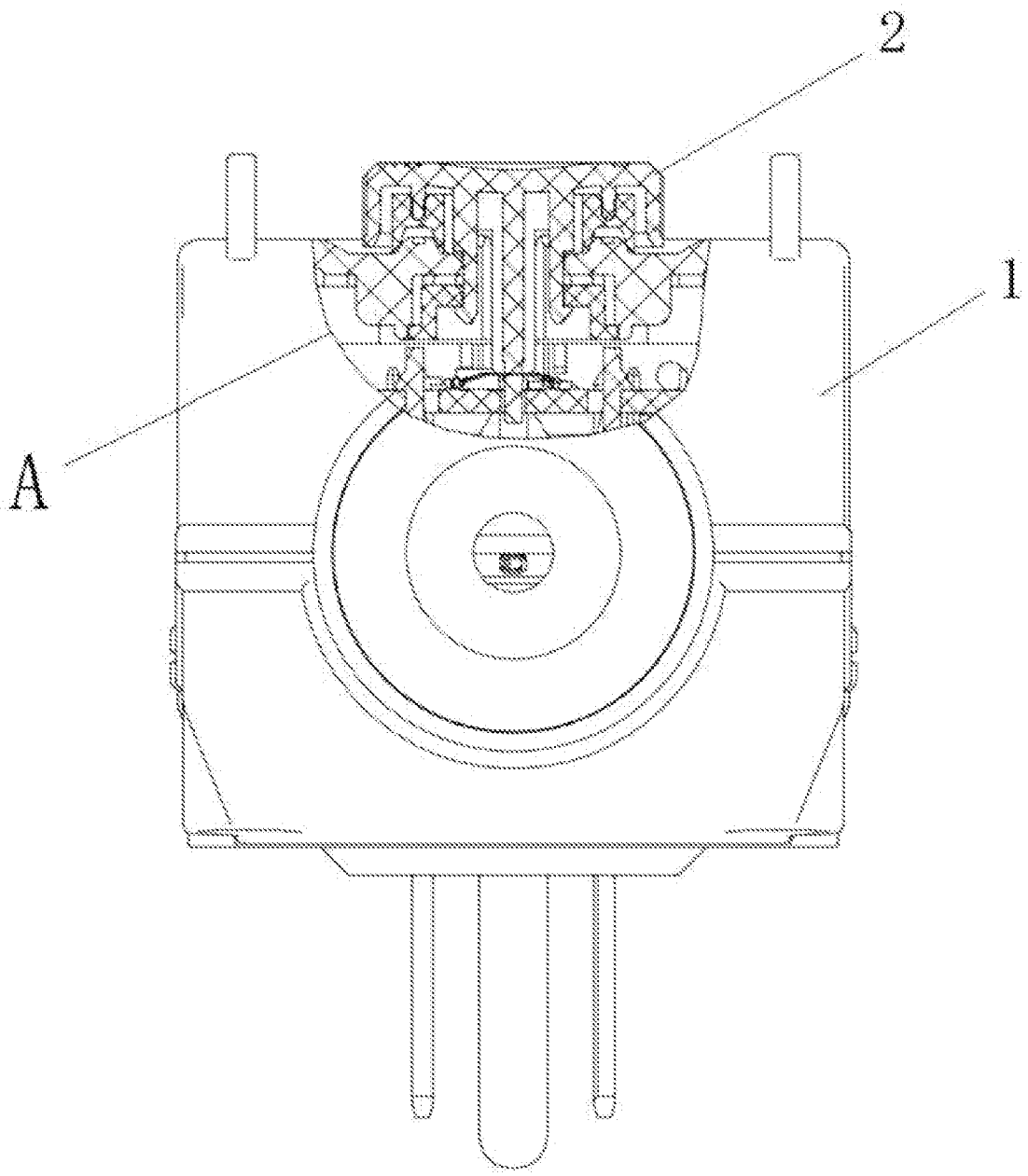
FIG. 6 schematically depicts assembly between the base plate and the brush in the housing in accordance with an embodiment of the present disclosure.
Figure 7:
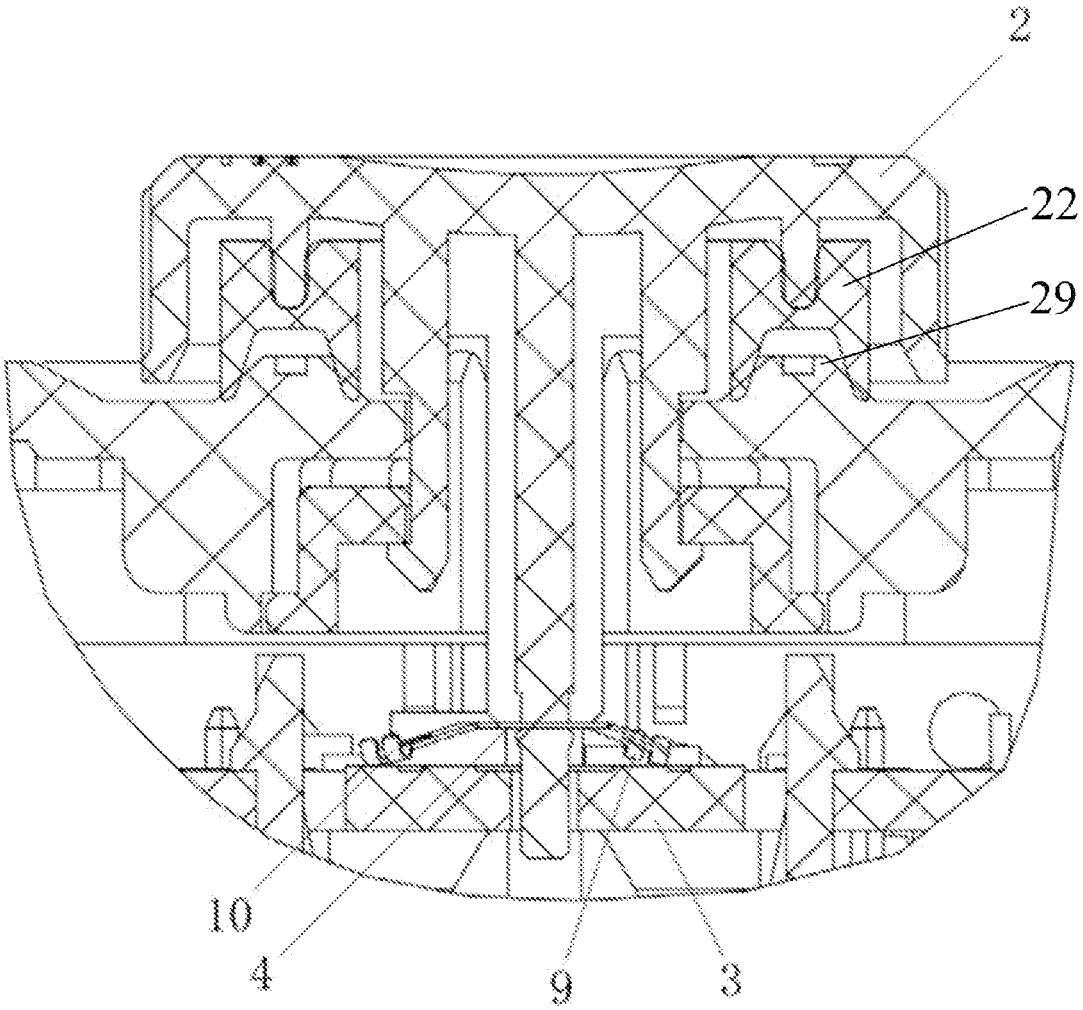
FIG. 7 is an enlarged view of area A in FIG. 6.

As shown in FIG. 5, the brush 4 is provided with a through hole 8. The first contact pin 9 and the second contact pin 10 are formed by the brush 4 extending in two different directions.

Figure 8:
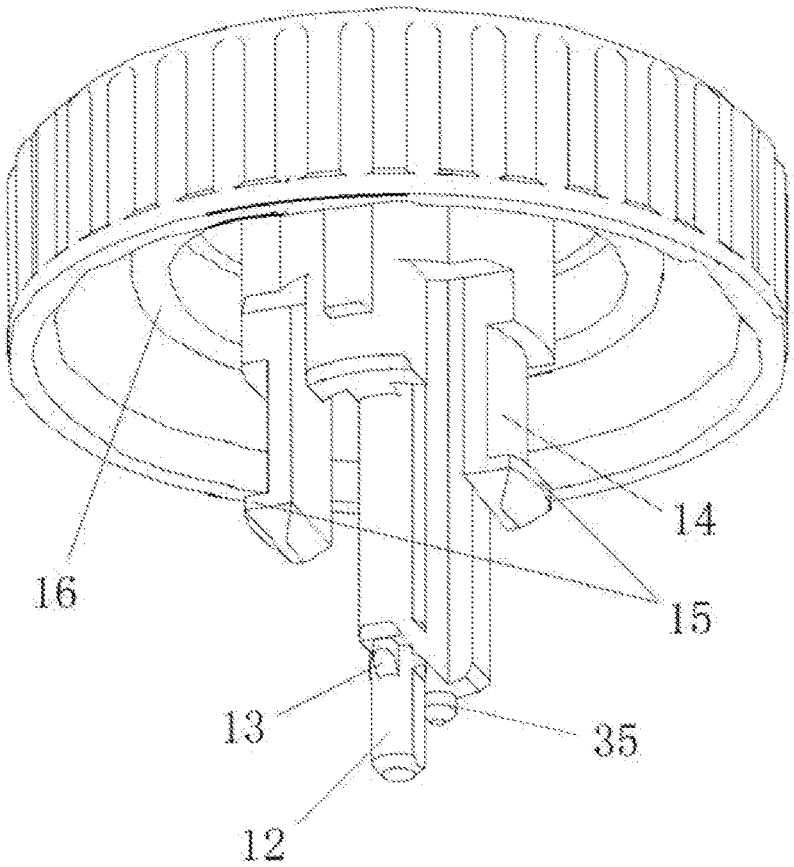
FIG. 8 is a perspective view of a knob in accordance with an embodiment of the present disclosure.

As shown in FIG. 8, in an embodiment, the actuating part 2 is further provided with a positioning part 35. The positioning part 35 is inserted into the through hole 8, so as to make the clamping connection between the actuating part 2 and the brush 4 more reliable.

Figure 14:
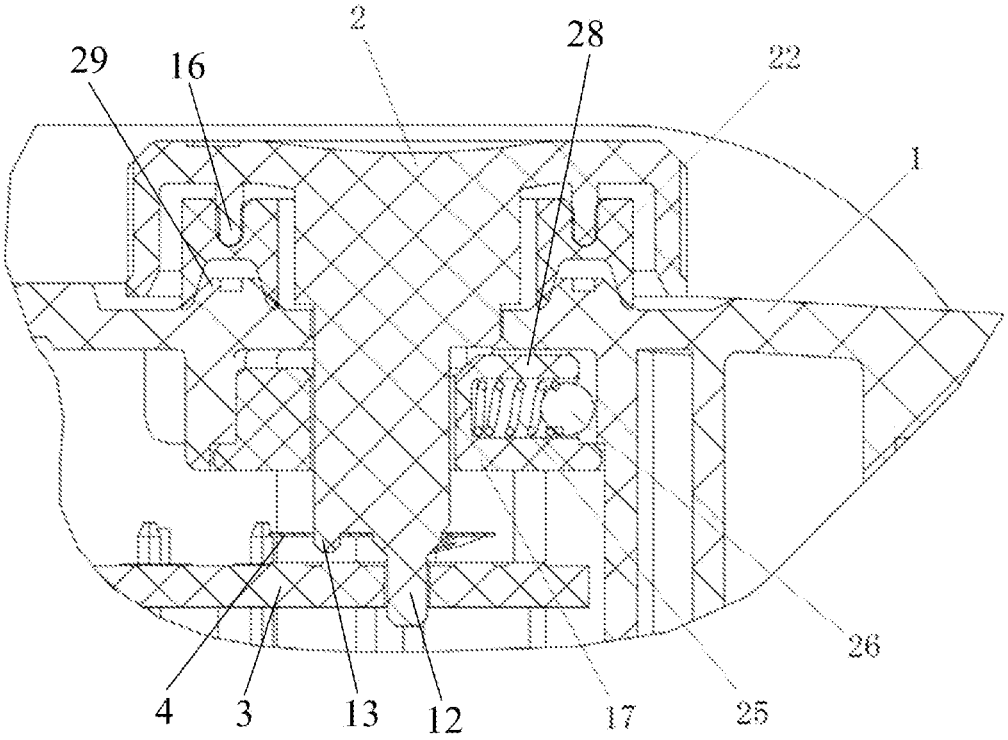
FIG. 14 is an enlarged view of area B in FIG. 13.
Figure 15:
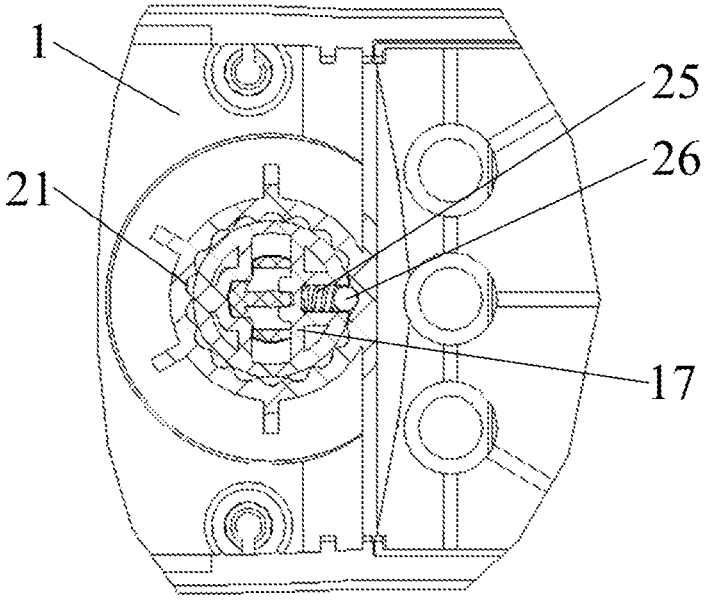
FIG. 15 schematically depicts matching between the hand-sensing mechanism and a positioning groove in accordance with an embodiment of the present disclosure.

As shown in FIGS. 14-15, in the leakage protector provided in this embodiment, a hand-sensing mechanism 28 is arranged in the housing 1. The actuating part 2 is connected to the hand-sensing mechanism 28. A plurality of positioning grooves 21 are provided on an inner wall of the housing 1. The hand-sensing mechanism 28 can be engaged with the positioning groove 21. The actuating part 2 can drive the hand-sensing mechanism 28 to rotate with respect to the housing 1, such that the hand-sensing mechanism 28 can be engaged with different positioning grooves 21 in sequence. The rotation of the actuating part 2 drives the hand-sensing mechanism 28 to be engaged with different positioning grooves 21 in turn. Therefore, when the actuating part 2 is rotated, an obvious gear-shifting sense (a feeling of stuttering) is generated, which facilitates the control of a contact position of the brush 4 and the second conducting strip 7, such that the setting of the power-on time of the leakage protector becomes more accurate.

As shown in FIGS. 14-15, the hand-sensing mechanism 28 includes a fixing seat 17, an elastic part 25 and a sliding part 26. The fixing seat 17 is connected to the actuating part 2. One end of the elastic part 25 is connected to the fixing seat 17, and the other end the elastic part 25 is connected to the sliding part 26. The sliding part 26 is engageable with the positioning groove 21, such that the actuating part 2 can drive the fixing seat 17 to rotate, so as to drive the sliding part 26 to move through the elastic part 25. In this way, the sliding part 26 is engaged with different positioning grooves 21 in sequence, and the elastic part 25 can provide the sliding part 26 with an elastic force to keep the sliding part 26 and the positioning groove 21 engaged. Specifically, a change range of the actuating part 2 can be felt through the hand-sensing mechanism 28. When the actuating part 2 is rotated, the sliding part 26 can be partially accommodated in different positioning grooves 21 in sequence, such that the sliding part 26 is engaged with different positioning grooves 21 in sequence. Therefore, the rotating of the actuating part 2 can produce a clear sense of gear, so as to facilitate the control of a contact position of the brush 4 and the second conducting strip 7, so as to more accurately control the set time.

When the actuating part 2 is rotating, the elastic part 25 is compressed, and the elastic part 25 provides the sliding part 26 with an elastic force to keep the sliding part 26 partially accommodated in the positioning groove 21, such that the sliding part 26 is partially accommodated in the positioning groove 21 at a first position, and is engaged with the positioning groove 21 at the first position. When the actuating part 2 rotates under an external force, the fixing seat 17 is driven to rotate. At this time, the elastic force of the elastic part 25 connected to the fixing seat 17 is overcome by the external force, the sliding part 26 rotates with respect to the housing 1, and the elastic member 25 is further compressed. When the sliding part 26 is partially accommodated in the positioning groove 21 at a second position, the external force applied to the actuating part 2 is removed, and the elastic part 25 is elastically reset. Under an elastic force of the elastic part 25, the sliding part 26 is partially accommodated in the positioning groove 21 at the second position to be engaged with the positioning groove 21 at the second position. The positioning groove 21 at the first position and the positioning groove 21 at the second position are different positioning grooves 21. The rotation of the actuating part 2 allows the sliding part 26 to be engaged with the positioning grooves 21 at different positions, such that the rotation of the actuating part 2 can produce an obvious sense of gear.

Figure 9:
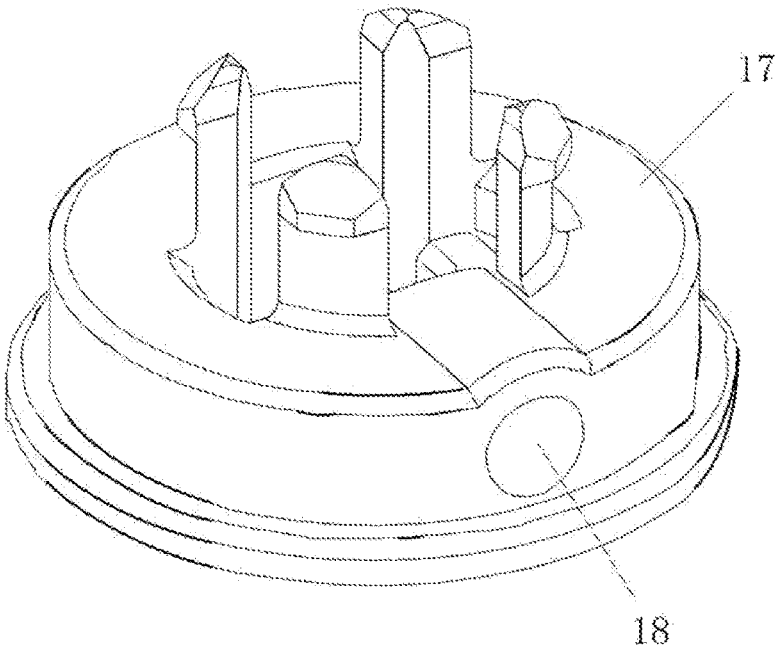
FIG. 9 is a perspective view of a fixing seat in accordance with an embodiment of the present disclosure.

As shown in FIGS. 9 and 14, a counterbore 18 is arranged on a side wall of the fixing seat 17. The elastic part 25 is arranged in the counterbore 18. The sliding part 26 is partially accommodated in the counterbore 18. In an embodiment, the elastic part 25 is a spring, and the sliding part 26 is a ball. The sliding part 26 can be partially accommodated in the counterbore 18. The counterbore 18 can guide the elastic part 25 and the sliding part 26.

Figure 11:
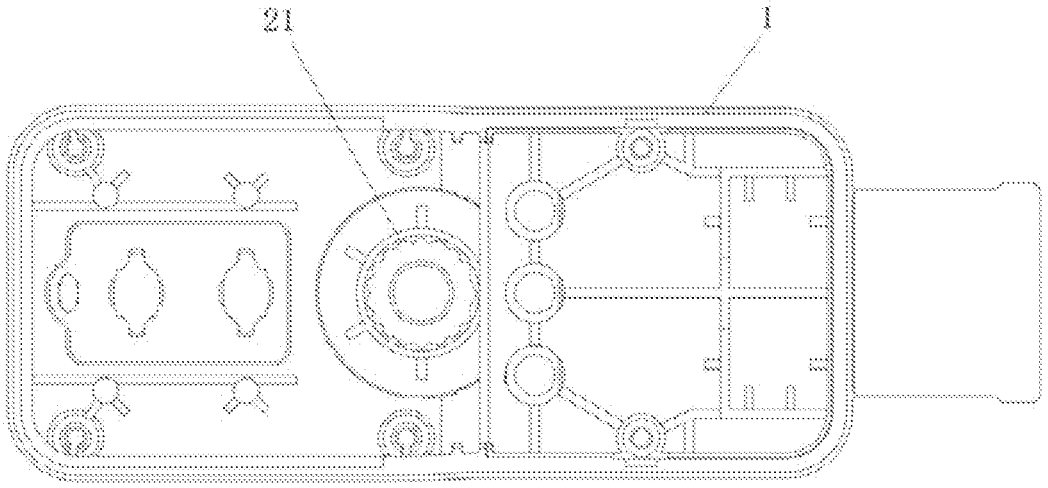
FIG. 11 is a top view of the housing in accordance with an embodiment of the present disclosure.

As shown in FIGS. 11, 14 and 15, the plurality of positioning grooves 21 spaced apart are arranged on the inner wall of the housing 1 along a circumferential direction. Driven by the actuating part 2, the sliding part 26 can be partially accommodated in the plurality of positioning grooves 21 in sequence, and engaged with the plurality of positioning grooves 21.

As shown in FIG. 14, the fixing base 17 is engaged with the actuating part 2.

Figure 10:
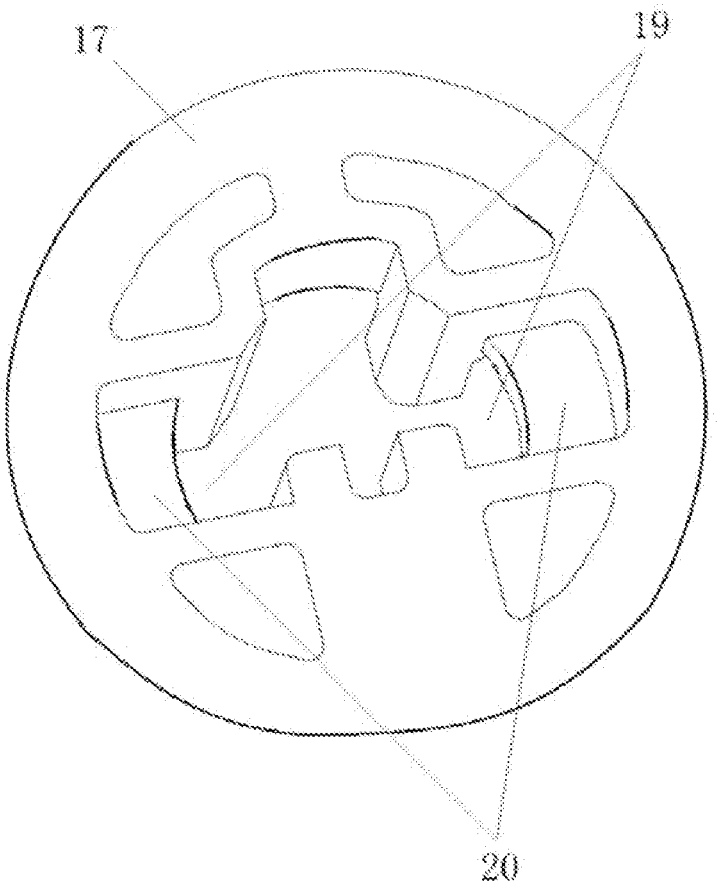
FIG. 10 is a bottom view of the fixing seat in accordance with an embodiment of the present disclosure.

As shown in FIGS. 8 and 10, an end of the actuating part 2 facing the brush 4 is provided with a clamping column 14. A clamping part 15 is arranged at a lower end of the clamping column 14. The fixing seat 17 is provided with a clamping slot 19. An inner wall of the clamping slot 19 is provided with a clamping parting surface 20. The clamping column 14 is inserted into the clamping slot 19, and the clamping part 15 is clamped with the clamping parting surface 20, so as to enable the fixing seat 17 to be clamped with the actuating part 2.

As shown in FIG. 14, a sealing ring 22 is provided between the actuating part 2 and the housing 1. The sealing ring 22 is configured enable sealing between the actuating part 2 and the housing 1, such that external objects such as dust and liquid cannot enter the housing 1 through a gap between the actuating part 2 and the housing 1.

Figure 12:
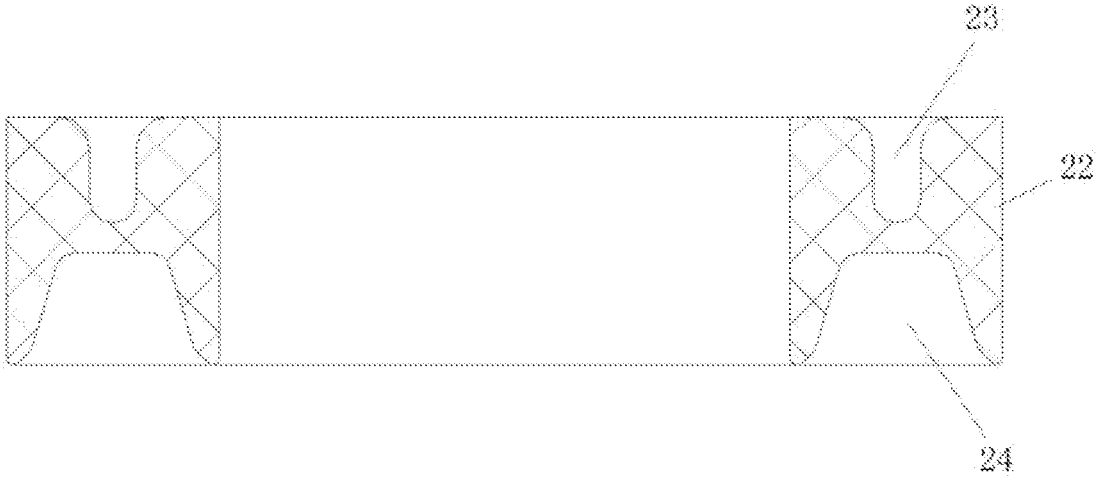
FIG. 12 is a sectional view of a sealing ring in accordance with an embodiment of the present disclosure.

As shown in FIGS. 12 and 14, a lower end of the actuating part 2 is provided with an inner annular wall 16. The housing 1 is provided with an annular protrusion 29 opposite to the inner annular wall 16. An upper end of the sealing ring 22 is provided with a first annular groove 23. The first annular groove 23 is configured for an insertion of the inner annular wall 16 to enable sealing between the sealing ring 22 and the actuating part 2. A lower end of the sealing ring 22 is provided with a second annular groove 24. The second annular groove 24 is configured for an insertion of the annular protrusion 29 to enable sealing between the sealing ring 22 and the housing 1.

Figure 13:
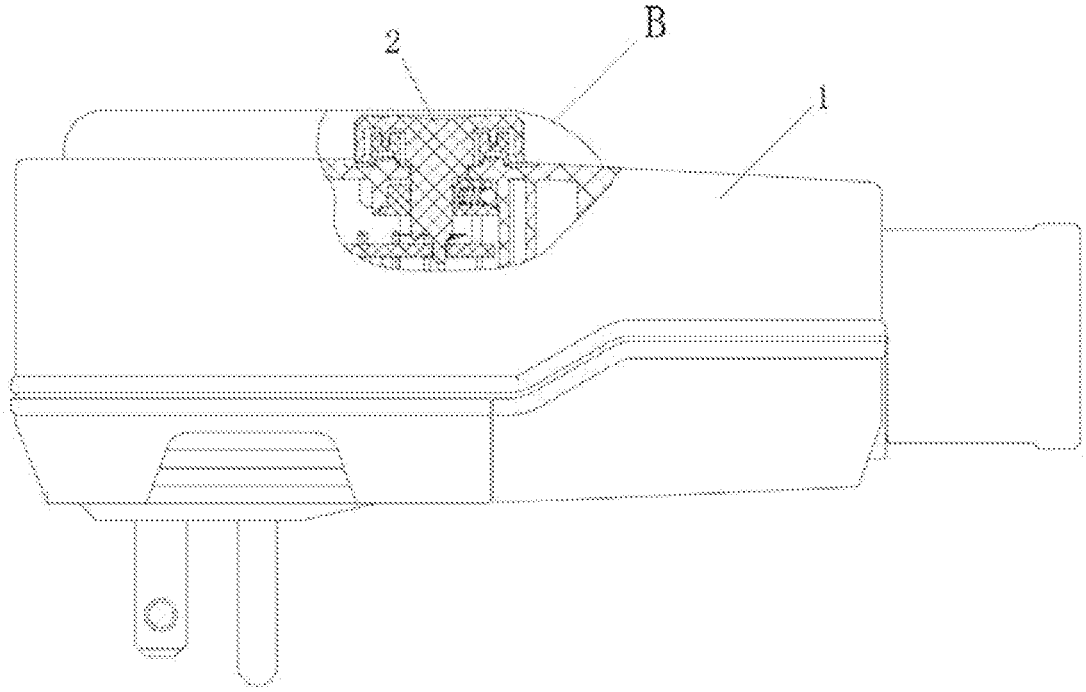
FIG. 13 shows assembly of a hand-sensing mechanism in the leakage protector in accordance with an embodiment of the present disclosure.

As shown in FIG. 13, the sealing ring 22 is in a sliding fit with the actuating part 2 and the housing 1. When the actuating part 2 is screwed, a sliding seal between the housing 1 and the actuating part 2 is achieved through the sliding fit of the actuating part 2, sealing ring 22 and the housing 1.

Obviously, the above-mentioned embodiments are illustrative, and not intended to limit this disclosure. For those skilled in the art, any modifications and variations without departing from the spirit of this disclosure should fall within the scope of the present disclosure defined by the appended claims.

What is claimed is:

1. A leakage protector, wherein the leakage protector is used to connect in series with external power equipment to control a timing shutdown of the external power equipment; the leakage protector comprises:

a housing;

wherein a base plate, a brush and a microprocessor are arranged in the housing; the brush is arranged on the base plate; the brush is movable with respect to the base plate; an actuating part is arranged on the housing; the brush is connected to the actuating part; the base plate is provided with a first conducting strip and a second conducting strip; the first conducting strip and the second conducting strip are spaced apart; the first conducting strip is electrically connected to the microprocessor;

the brush is provided with a first contact pin and a second contact pin; the first contact pin is in contact with the first conducting strip; the second contact pin is in contact with the second conducting strip; the actuating part is configured to drive the brush to move, such that the first contact pin is in contact with different positions of the first conducting strip, and the second contact pin is in contact with different positions of the second conducting strip, so as to allow the second conducting strip to generate different analog voltages;

the first conducting strip is configured to receive an analog-voltage signal generated by the second conducting strip, and transmit the analog-voltage signal to the microprocessor; and the microprocessor is configured to control the leakage protector to turn off after reaching a power-on time corresponding to the analog-voltage signal according to the received analog-voltage signal, such that the external power equipment is turned off.

2. The leakage protector of claim 1, wherein the second conducting strip comprises a plurality of conductive areas respectively corresponding to the different analog voltages; and the second contact pin is configured to contact the plurality of conductive areas, so as to allow the second conducting strip to generate the different analog voltages corresponding to the plurality of conductive areas.

3. The leakage protector of claim 1, wherein the second conducting strip is provided with a notch; and when the second contact pin is accommodated in the notch, the second conducting strip does not generate an analog voltage.

4. The leakage protector of claim 1, wherein a hand-sensing mechanism is arranged in the housing; the actuating part is connected to the hand-sensing mechanism; a plurality of positioning grooves are provided on an inner wall of the housing; the hand-sensing mechanism is engageable with the plurality of positioning grooves; and the actuating part is configured to drive the hand-sensing mechanism to rotate with respect to the housing, such that the hand-sensing mechanism is able to engage with the plurality of positioning grooves in sequence.

5. The leakage protector of claim 4, wherein the hand-sensing mechanism comprises a fixing seat, an elastic part and a sliding part; the fixing seat is connected to the actuating part; one end of the elastic part is connected to the fixing seat; the other end of the elastic part is connected to the sliding part; the sliding part is engageable with the plurality of positioning grooves; the actuating part is configured to drive the fixing seat to rotate, so as to drive the sliding part to move through the elastic part to allow the sliding part to be engaged with the plurality of positioning grooves in sequence; and the elastic part is configured to provide the sliding part with an elastic force to keep the sliding part in engagement with one of the plurality of positioning grooves.

6. The leakage protector of claim 5, wherein a counterbore is arranged on a side wall of the fixing seat; the elastic part is arranged in the counterbore; and the sliding part is partially accommodated in the counterbore.

7. The leakage protector of claim 6, wherein the fixing seat is provided with a clamping slot; an inner wall of the clamping slot is provided with a clamping parting surface; an end of the actuating part facing the brush is provided with a clamping column; a clamping part is arranged at a lower end of the clamping column; the clamping column is inserted into the clamping slot; and the clamping part is clamped with the clamping parting surface, so as to enable the fixing seat to be clamped with the actuating part.

8. The leakage protector of claim 1, wherein the brush is rotatably connected to the base plate; and the actuating part is configured to drive the brush to rotate, such that the first contact pin is in contact with different positions of the first conducting strip, and the second contact pin is in contact with different positions of the second conducting strip.

9. The leakage protector of claim 8, wherein the first conducting strip and the second conducting strip are concentrically arranged, and both have in a ring structure.

10. The leakage protector of claim 8, wherein the base plate is provided with a positioning hole; the actuating part is provided with a positioning shaft; the positioning shaft is inserted into the positioning hole, such that the actuating part is rotatably connected to the base plate; the positioning shaft is provided with a limiting protrusion; the brush is provided with a connecting hole configured for matching with the limiting protrusion; and the limiting protrusion is inserted into the connecting hole, so as to enable the actuating part to be clamped with the brush.

11. The leakage protector of claim 1, wherein a sealing ring is provided between the actuating part and the housing; and the sealing ring is configured to enable sealing between the actuating part and the housing.

12. The leakage protector of claim 11, wherein a lower end of the actuating part is provided with an inner annular wall; the housing is provided with an annular protrusion opposite to the inner annular wall; an upper end of the sealing ring is provided with a first annular groove; the first annular groove is configured for insertion of the inner annular wall to enable sealing between the sealing ring and the actuating part; a lower end of the sealing ring is provided with a second annular groove; and the second annular groove is configured for insertion of the annular protrusion to enable sealing between the sealing ring and the housing.

* * * * *